United States Patent [19]

Vodicka

[11] 4,259,712

[45] Mar. 31, 1981

[54] SEALED, PREFOCUSED MOUNT FOR PLASTIC PAR LAMP

[75] Inventor: Vincent Vodicka, South Euclid, Ohio

[73] Assignee: General Electric Company, Schenectady, N.Y.

[21] Appl. No.: 921,490

[22] Filed: Jul. 3, 1978

[51] Int. Cl.[3] ..... F21V 7/00; H01R 4/70

[52] U.S. Cl. ..... 362/310; 339/218 L; 362/306

[58] Field of Search ..... 339/144, 145, 218; 362/267, 306; 313/113

[56] References Cited

U.S. PATENT DOCUMENTS

| | | | |
|---|---|---|---|
| 1,712,217 | 5/1929 | Kelsea | 362/306 |
| 2,502,860 | 4/1950 | Leithiser | 339/218 R |
| 2,535,773 | 12/1950 | Yoder | 339/145 D |
| 2,590,160 | 3/1952 | Dixon | 339/218 R |
| 3,093,434 | 6/1963 | Francis | 339/218 R |
| 3,314,331 | 4/1967 | Wiley | 362/296 |
| 3,458,747 | 7/1969 | Gainer et al. | 339/144 T |
| 3,705,380 | 12/1972 | Roberts | 339/218 R |
| 3,784,807 | 1/1974 | Boekkool et al. | 362/267 |
| 3,852,631 | 12/1974 | Evans | 339/144 R X |
| 3,909,607 | 9/1975 | Vause | 313/113 |
| 3,917,939 | 11/1975 | Schmidt | 313/113 |
| 4,019,045 | 4/1977 | Bassett | 362/267 |
| 4,156,271 | 5/1979 | Vercellotti | 362/202 |

FOREIGN PATENT DOCUMENTS

| | | | |
|---|---|---|---|
| 2301120 | 3/1976 | France | 339/218 R |
| 2308197 | 10/1976 | France | 339/144 R |
| 2319843 | 11/1977 | France | 362/306 |

OTHER PUBLICATIONS 1960, (Sep.), GE, RTV Ad.

2/1957, Alden Products Ad.

7/1956 Electronic Equipment Potting Aircraft Electrical Connectors by Nadler, Mallard & Bowen, p. 58.

*Primary Examiner*—J. V. Truhe

*Assistant Examiner*—Shelley Wade

*Attorney, Agent, or Firm*—Sidney Greenberg; Lawrence R. Kempton; Philip L. Schlamp

[57] ABSTRACT

A prefocused mount is disclosed which is hermetically sealed to a plastic reflector for a PAR lamp.

13 Claims, 3 Drawing Figures

10

20

SEALED, PREFOCUSED MOUNT FOR PLASTIC PAR LAMP

This invention relates to PAR (Parabolic Aluminized Reflector) lamps and, in particular, to a prefocused mount for hermetic sealing to an all-plastic PAR lamp or a PAR lamp comprising a plastic reflector.

This invention also relates to commonly assigned, copending applications Ser. Nos. 896,707, filed Apr. 17, 1978, and 916,490, filed June 19, 1978.

Prior to about 1940 in the U.S.A. and currently in Europe, prefocused inner lamps have been used in conjunction with metal or other reflectors in automotive headlamps. These inner lamps are generally mechanically secured, not sealed, to the reflector.

Sealed beam lamps are sealed by a solder joint between the ferrule and lead wire and by the ferrule being embedded in the glass.

A problem develops with plastic lamps in that attempts at sealing the lugs and/or lead wires, eg. by ultrasonic welding, do not result in a permanent seal. Usually, the adhesion between the metal parts and the plastic is lost due to thermal cycling of the lamp in use or, more specifically, the different expansion rates of the parts as the parts are heated by the lamp in use. For example, brass has a thermal coefficient of expansion (TCE) of $21.2\times10^{-6}$ cm./cm./° C. whereas polycarbonate has a TCE of $68.4\times10^{-6}$ cm./cm./° C.

Another problem is in mounting the inner lamp to the reflector. As lamps are now made, the filament, whether bare or within an inner lamp, is positioned at or near the focus of the reflector and the leads are fastened to the reflector to hold the filament at the desired location. With the greater molding precision obtainable with plastic as compared to glass, it is desirable to use a prefocused mount to eliminate the individual focusing required of presently available PAR lamps.

In view of the foregoing, it is therefore an object of the present invention to provide an improved PAR lamp having a plastic reflector.

Another object of the present invention is to provide a prefocused mount for plastic PAR reflectors in which the lead wires and lugs are sealed.

A further object of the present invention is to provide a hermetic seal of a prefocused mount for a plastic reflector lamp.

Another object of the present invention is to provide an accurate mounting of a sealed prefocused mount for PAR lamps.

The foregoing objects are achieved in the present invention wherein the mount comprises mating plastic halves, shaped to receive the lead wires with lugs attached, and having a cavity for the elastomeric adhesive. The halves are joined, eg. by ultrasonic welding, to enclose the attachment which is potted in the elastomeric adhesive. The mount is then fitted to reference features molded in the rear, outer surface of the reflector and bonded thereto.

A more complete understanding of the present invention can be obtained by considering the following detailed description in conjunction with the accompanying drawings, in which.

Figure 1:
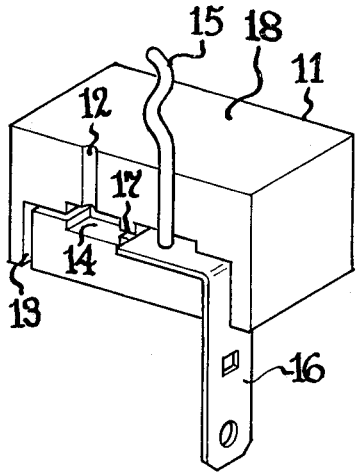
FIG. 1 illustrates parts of a mount in accordance with the present invention.

FIG. 1 illustrates a mount in accordance with the present invention prior to final assembly. Specifically, mount 10 comprises a plastic, eg. polycarbonate, block 11 having channels such as channel 12 in one side thereof for receiving lead wires and channels such as channel 13, in the other side thereof for receiving the lug used to connect the finished lamp to a suitable power source. These channels are connected by a chamber or cavity 14 which forms an enlarged opening within the plastic mount and serves to contain the connection between lead wire 15 and lug 16. Chamber 14 further serves as a container for an elastomeric polymer that will adhere to both the plastic of block 11 and the metals used for the leads and lugs. Channels 12 and 13, while parallel, need not be collinear. For example, as illustrated in FIG. 1, channels 12 and 13 are parallel but offset to the particular shape of lug 16. It is preferred that lug 16 have the L-shaped configuration illustrated in FIG. 1 so that the forces exerted on the mount in attaching a suitable connector to the lugs is borne by a large surface area within the mount.

Mounts in accordance with the present invention are made by first attaching the lead wire to the lug, eg. by crimping or welding. A quantity of elastomeric polymer is inserted into cavity 14 and the combined lead and lug inserted into the channels formed in block 11. A corresponding block, either solid or having identical channels and cavities also having elastomeric polymer inserted therein, is then placed over block 11 and ultrasonically bonded thereto. The elastomer thus encapsulates the lugs and leads and, when cured, provides an adhesive seal between all surfaces. The cure of the elastomer need only be sufficiently rapid that it be completed between the time mount 10 is made and the time mount 10 is attached to a reflector.

Suitable elastomeric polymers include silicone rubber compounds such as what is known as RTV, or other elastomeric polymers such as polyurethane. The only requirements of the elastomeric polymer is that, when cured, it adheres to the plastic block and the metals used for the leads and lugs, eg. nickel clad iron and brass, respectively, throughout lamp life, thus assuring hermeticity of the seal.

Upper surface 18, as illustrated in FIG. 1, and periphery of mount 10 acts as the reference surface from which the light source is located. This is readily done mechanically in a suitable fixture or jig. The mount is thus prefocused which expedites the manufacture of the lamp since only further mechanical assembly is required.

During the operation of the lamp, the elastomeric polymer compensates for the difference in thermal coefficients of expansion between the various lamp mount components, thus maintaining a hermetic seal. While the elastomeric polymer encloses the connection between the leads and lug, thereby protecting same from corrosion, the plastic mount, in turn, by encapsulating the elastomeric polymer, protects the polymer from attack by an adverse environment.

Figure 2:
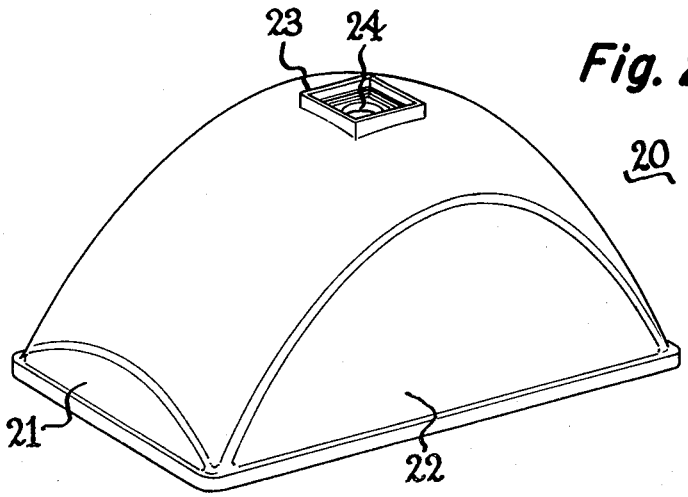
FIG. 2 illustrates a reflector in accordance with the present invention to which the mount of FIG. 1 is attached.

In FIG. 2, reflector 20 is provided with a suitable receptacle for receiving the mount illustrated in FIG. 1. Specifically, reflector 20, while illustrated as rectangular may be either round or rectangular, and is provided with a central boss 23 at the apex thereof. Boss 23 is provided with an aperture 24 through which the lead wires of the mount are inserted. (A suitable light source having been attached to the lead wires.)

Figure 3:
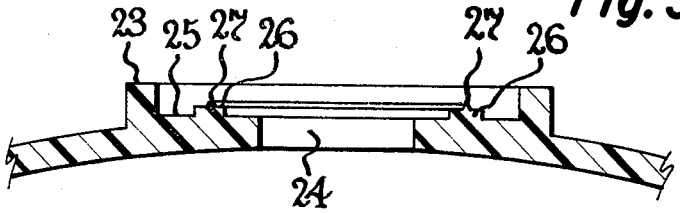
FIG. 3 illustrates a detail of the reflector of FIG. 2.

The structure of boss 23 may best be understood by also considering FIG. 3 which illustrates the boss in cross-section. Specifically, boss 23 comprises a wall surrounding an inner plateau 25. This plateau is orthogonal to the optical axis of the lamp and serves as a general reference surface or plane. The actual location of the mount along the lamp axis is determined by ridge 26 having peak portion 27 located therein. Peak portion 27 provides material for deformation during the ultrasonic bonding of mount 10 to ridge 26. Thus, the walls of boss 23 locate mount 10 along axes orthogonal to the optical axis of the lamp while ridge 26 locates mount 10 along the optical axis of the lamp. Thus, when ultrasonically bonded, mount 10 is fixed with respect to the three axes of the lamp. Since the filament was previously located with respect to mount 10, ie. mount 10 is prefocused, assembling mount 10 into reflector 20 automatically focuses the lamp. Further, since mount 10 is bonded to ridge 26, the interior of the lamp is hermetically sealed against the outside environment, assuming a lens is similarly sealed to the open face of reflector 20.

There is thus provided by the present invention a prefocused mount which not only facilitates assembly of the lamp but also seals both the inside of the lamp and the connections to the lead wires against the external environment since each sub-assembly of the lamp is sealed, in turn, to the next. Since the mount is permanently attached to the reflector, the factory alignment of the lamp is not lost in subsequent handling.

Having thus described the invention it will be apparent to those of skill in the art that various modifications can be made within the spirit and scope of the present invention. For example, as previously noted, a variety of elastomeric polymers may be utilized provided they fulfill the condition that they adhere to both metal and plastic. Similarly, while illustrated as having a square shape, mount 10 and the walls of boss 23 may comprise any suitable shape which serves to locate mount 10 along the two orthogonal axes to the optical axis of the lamp and which prevents rotation of the mount about the optical axis. Suitable light sources include an incandescent inner bulb or a discharge lamp.

What I claim as new and desire to secure by U.S. Letters Patent is:

1. A sealed reflector lamp comprising:

a plastic reflector;

a lens sealed to said reflector;

at least two electrical connecting means;

a plastic block of predetermined shape and having an upper reference surface, enclosing and securing in fixed relation within said block portions of said connecting means, comprising mating halves, each half defining at least two pairs of channels, each pair interconnected by a cavity, for receiving portions of said connecting means;

an elastomeric polymer in the cavities of said block for sealing the paths through said block formed by said channels when said halves are joined; and a light source connected to the exterior ends of said electrical connecting means in specified relation with said predetermined shape and reference surface;

said reflector having a receptacle means for receiving and locating said block and light source in predefined relation relative to said reflector;

said mount being sealed and secured to said receptacle means of said reflector.

2. Sealed reflector lamp as set forth in claim 1 wherein said channels are parallel and not collinear.

3. Sealed reflector lamp as set forth in claim 1 wherein said electrical connecting means comprise at least two lead wires each joined to an L-shaped lug.

4. Sealed reflector lamp as set forth in claim 3 wherein said lead wires are connected to the short side of said lugs.

5. Sealed reflector lamp as set forth in claim 1 wherein said block comprises polycarbonate.

6. Sealed reflector lamp as set forth in claim 5 wherein said elastomeric polymer is selected from the group consisting of silicon rubber and polyurethane.

7. Sealed reflector lamp as set forth in claim 1 wherein said block comprises identical halves.

8. The reflector lamp unit as set forth in claim 1 wherein said receptacle means comprises:

a boss at the apex of said reflector, said boss comprising a wall which engages the predetermined shape of said block to locate said block in a plane orthogonal to the axis of said lamp.

9. The lamp as set forth in claim 8 wherein said receptacle means further comprises a plateau having a ridge for locating said reference surface along the axis of said lamp.

10. A sealed reflector lamp comprising:

a lens;

a polymer reflector sealed to said lens in cooperative relation;

a sealed polymer mounting block having a predetermined exterior shape and reference surface having electrical leads sealed in fixed relation therethrough and having a light source secured in a fixed and predetermined relation therewith;

receptacle means on said reflector engaging in predetermined relation said exterior shape and reference surface of said mounting block and predeterminedly positioning said light source with respect to said reflector;

and means to seal and secure said block to said reflector.

11. The sealed reflector lamp of claim 1 wherein said mating halves are bonded together in a substantially planar seam.

12. The sealed reflector lamp of claim 11 wherein said seam is transverse to said reference surface.

13. The sealed reflector lamp of claim 11 wherein said halves of said block are ultrasonically bonded together.

* * * * *